US007380363B1

(12) United States Patent
Kirschner

(10) Patent No.: US 7,380,363 B1
(45) Date of Patent: Jun. 3, 2008

(54) REPLACEABLE BLANK FIRING BARREL

(76) Inventor: Neal A. Kirschner, 2113 Rockledge Dr., Rockledge, FL (US) 32955

( * ) Notice: Subject to any disclaimer, the term of this patent is extended or adjusted under 35 U.S.C. 154(b) by 0 days.

(21) Appl. No.: 11/043,725

(22) Filed: Jan. 26, 2005

(51) Int. Cl.
*F41A 21/00* (2006.01)

(52) U.S. Cl. ..... 42/76.01; 42/77; 89/14.05; 89/29

(58) Field of Classification Search ..... 42/76.01, 42/77; 89/14.05, 29
See application file for complete search history.

(56) References Cited

U.S. PATENT DOCUMENTS

| | | | | |
|---|---|---|---|---|
| 1,092,157 | A | 4/1914 | Mauser | |
| 1,517,328 | A | 12/1924 | Weiss | |
| 3,645,027 | A | 2/1972 | Palmer | 42/77 |
| 3,732,776 | A | 5/1973 | Snodgrass | 89/14 E |
| 3,766,822 | A | 10/1973 | Sophinos | 89/14 E |
| 4,455,777 | A | 6/1984 | Callies | 42/59 |
| 4,907,489 | A | 3/1990 | Teague | 89/14.5 |
| 5,140,893 | A | 8/1992 | Leiter | 89/14.5 |
| 5,433,134 | A | 7/1995 | Leiter | 89/14.5 |
| 5,585,589 | A | 12/1996 | Leiter | 89/128 |
| 5,675,106 | A | 10/1997 | Leiter | 89/14.5 |
| 5,829,180 | A | 11/1998 | Leiter | 42/77 |
| 6,176,032 | B1 | 1/2001 | Cohen et al. | 42/96 |
| 6,202,533 | B1 * | 3/2001 | Reynolds et al. | 89/14.5 |
| 6,276,252 | B1 | 8/2001 | Dionne | 89/29 |
| 6,357,331 | B1 | 3/2002 | Dionne | 89/29 |

* cited by examiner

*Primary Examiner*—Michelle Clement
(74) *Attorney, Agent, or Firm*—Brian S. Steinberger; Law Offices of Brian S. Steinberger, P.A.

(57) ABSTRACT

A blank firing barrel for use with handguns is disclosed. The blank firing barrel is sized to be substituted for an existing live-ammunition firing barrel in a handgun. The blank firing barrel can be machined from a solid block of metal such as stainless steel so that the barrel end is a contiguous portion of the original solid metal block. A downwardly angled small pressure release hole can be drilled into the closed end so that gasses from firing the blank can be safely discharged. The open end of the blank firing barrel can be sized to only accept ammunition being smaller in diameter than regular ammunition that is used for the handgun. The under rear edges of the blank firing barrel can be angled so that said barrel safely recoils within the handgun when it is fired.

3 Claims, 7 Drawing Sheets

FACTORY 9mm AMMUNITION

MFG. RES. BLANK

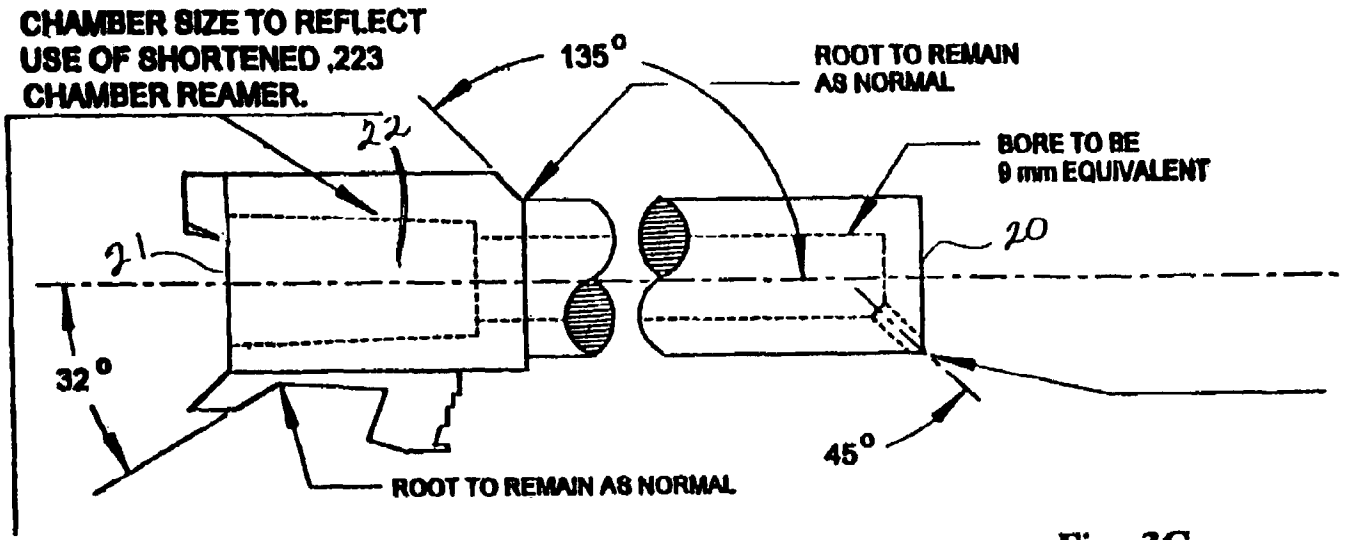
Fig. 3A
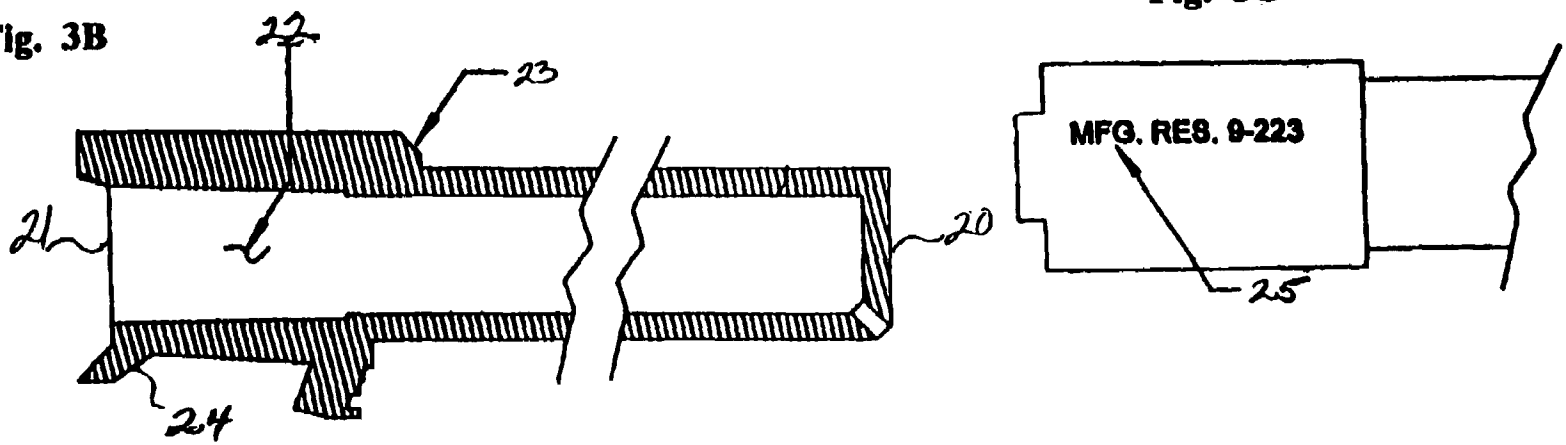
Fig. 3B
Fig. 3C

SECTION A—A
SHOWING CLOCKING
OF BLEED HOLE

SECTION B—B
SHOWING ANGLE
OF BLEED HOLE

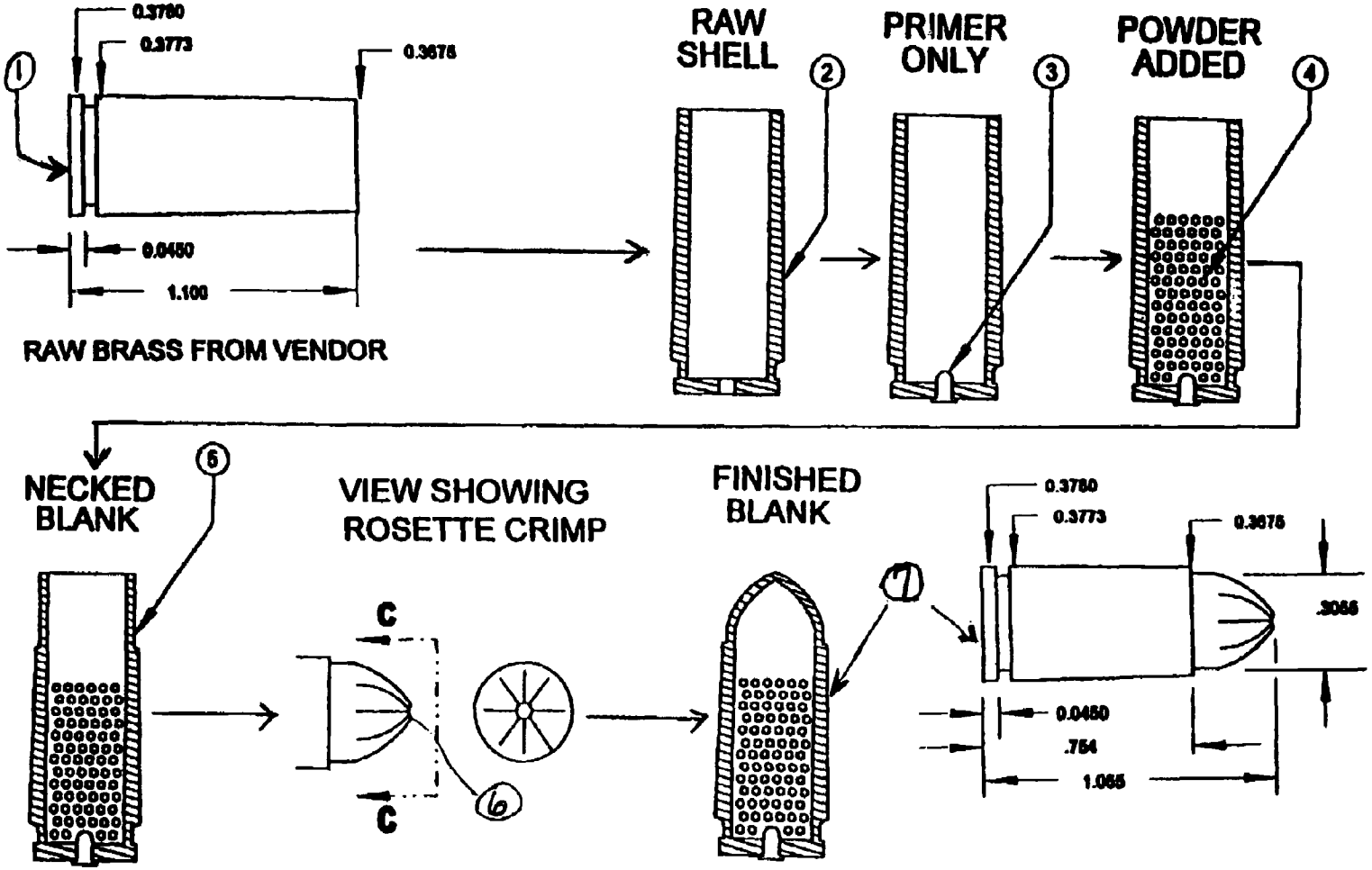
Fig. 6 - Fabrication of Blank Cartridge

REPLACEABLE BLANK FIRING BARREL

BACKGROUND AND PRIOR ART

This invention relates to firearms, in particular to a replaceable barrel unit that can fire non-lethal blanks and be substituted for existing barrels in handguns.

Handguns have been modified over the years to be able to fire blanks. Early in the twentieth century, screw-in inserts (U.S. Pat. No. 1,092,157 to Mauser) and subcaliber practice barrels (U.S. Pat. No. 1,517,328 to Weiss) were developed to modify handguns for firing blanks. Another typical technique for modifying the barrel on a handgun is either to plug or cap the open barrel end as described in U.S. Pat. No. 5,829,180 to Leiter or U.S. Pat. No. 6,176,032 to Cohen et al. and U.S. Pat. No. 3,766,822 to Sophinos, or provide a restrictor type washer inside the barrel. However, there are many problems with these well known techniques. For example, the existing barrels must be permanently modified in order to use these separate components which usually ruins the barrel's use for firing real ammunition. Thus, users must purchase new barrels in order to reuse the handgun to fire real ammunition, which is an added expense as well as an extra time consuming matter. Additionally, the separate components such as the plugs can be dangerous since these components can detach from the barrels and become moving projectiles when the handgun is being fired. Still furthermore, many of the blank firing handguns use real ammunition when being fired, which can also become dangerous if the plug type components fail and the real ammunition passes out of the firing handgun.

Other blank firing devices describe replaceable barrels with multiple parts, such as, inserts, recoil boosters as described in U.S. Pat. Nos. 4,907,489; 5,140,893; 5,433,134; 6,357,331. Still furthermore, many of the prior art techniques require extensive modifications and many added parts and assembly required to be used with existing handguns, which is also an extra time consuming expense.

Thus, the need exists for solutions to the above problems with the prior art.

SUMMARY OF THE INVENTION

The first objective of the present invention is to provide a blank firing barrel for all known handguns that provides a safe system for law enforcement, security and personnel protection that can include near live firing, close quarter combat, other training activities, and theatrical enactments.

The second objective of the present invention is to provide a blank firing barrel for handguns that does not use a plug, cap or restrictor component inside the barrel.

The third objective of the present invention is to provide a blank firing barrel for handguns that does not permanently destroy the existing barrel on the handguns.

The fourth objective of the present invention is to provide a blank firing barrel for handguns that can be easily substituted for the existing barrels on the handgun, and does not require any customization of an existing handgun to be used.

The fifth objective of this invention is to provide a blank firing barrel for handguns where the barrel end has not been opened by drilling, machining, and the like, so that no material can become a projectile.

The sixth objective of the invention is to provide a blank firing barrel for handguns that will not accept live ammunition.

The seventh objective of the invention is to provide a blank firing barrel for handguns that allows for barrel recoil when firing the blanks to effect a shock absorbing function so that its use more closely replicates firing of real ammunition.

The eighth objective of the invention is to provide a blank cartridge for use with the replaceable blank firing barrel.

Further objects and advantages of this invention will be apparent from the following detailed description of a presently preferred embodiment that is illustrated schematically in the accompanying drawings.

BRIEF DESCRIPTION OF THE FIGURES

FIG. 3A shows a side view of the novel replaceable blank firing barrel.

FIG. 3B shows a cross sectional side view of the replaceable blank firing barrel with outline of internal and external features.

FIG. 3C shows a top view of the novel replaceable barrel of FIG. 3A with engraving detail.

FIG. 6 shows the steps for fabricating a modified blank cartridge for use in the novel replaceable blank firing barrel.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
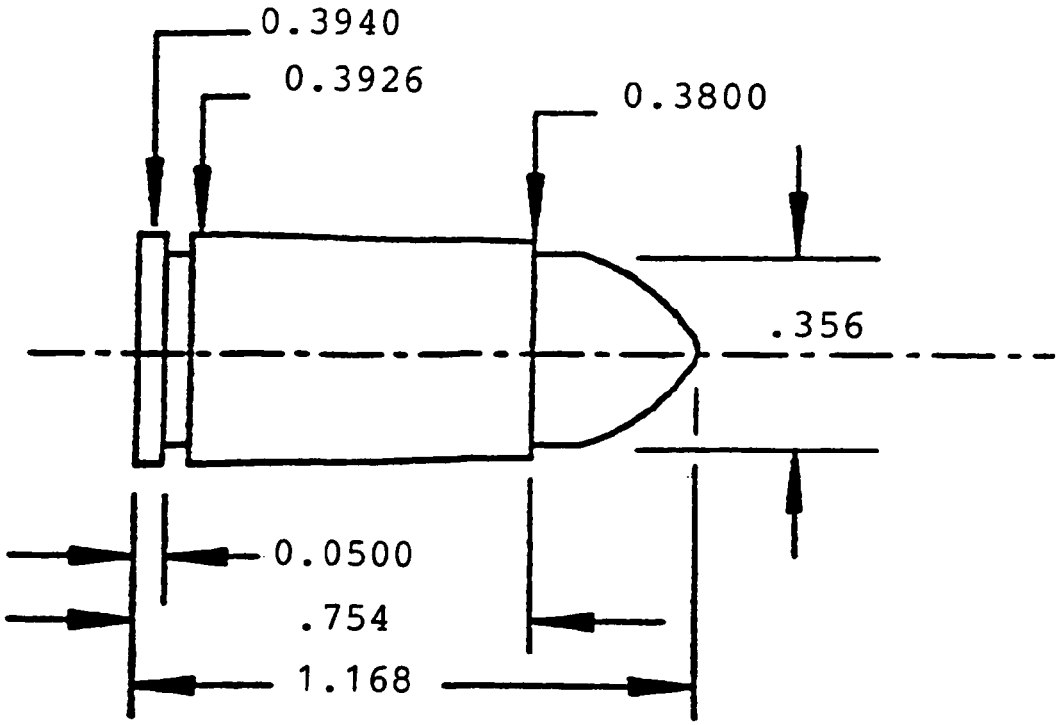
FIG. 1 shows a side view of a prior art 9 mm ammunition cartridge.

FIG. 1 shows a side view of a prior art 9 mm ammunition cartridge such as a 9 mm cartridge having an outer diameter of approximately 0.38 inches.

Figure 2:
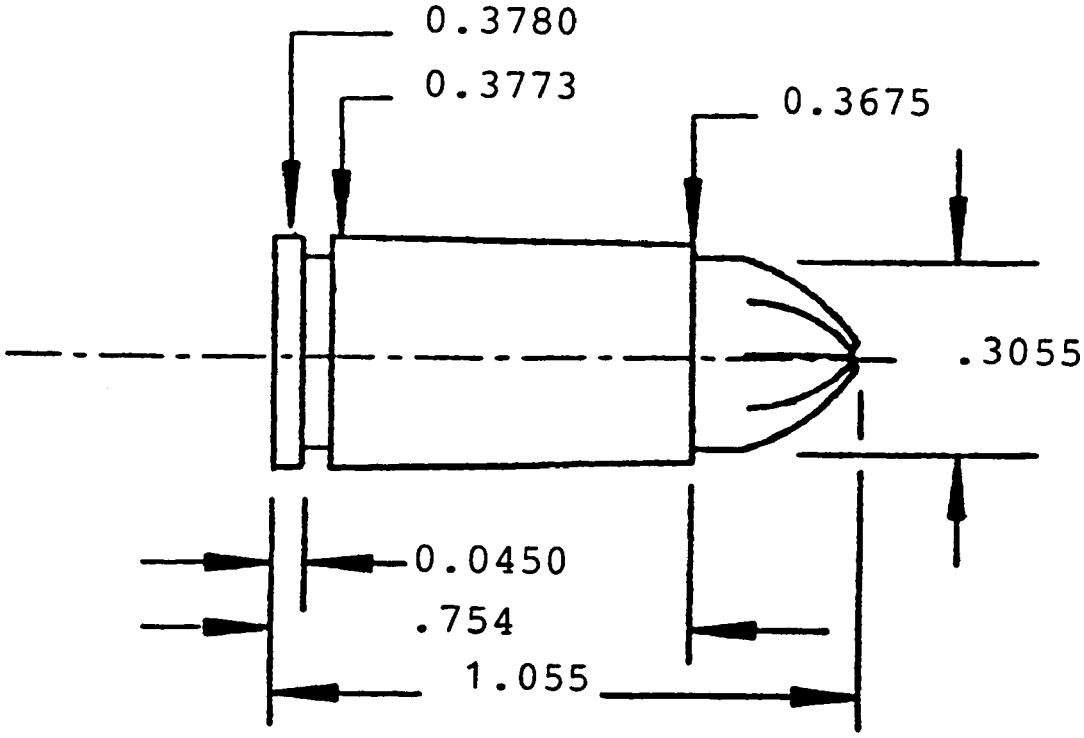
FIG. 2 shows a side view of a modified blank cartridge for use with the novel replaceable blank firing barrel.
Figure 4A:
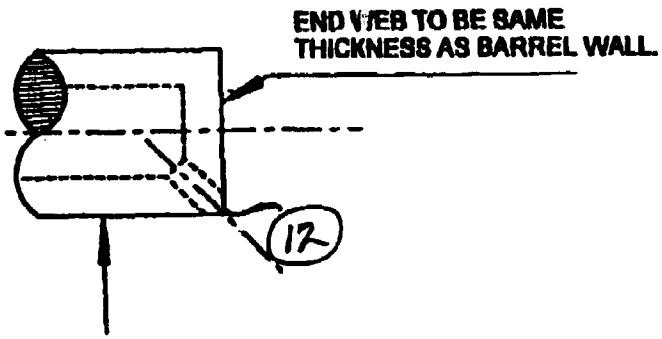
FIG. 4A shows a side view of the front section of the barrel of FIG. 3A.
Figure 4B:
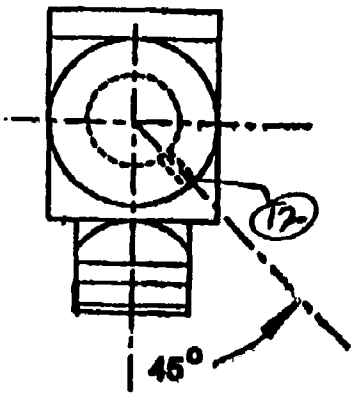
FIG. 4B shows a front end view of the barrel of FIG. 3A.
Figure 4C:
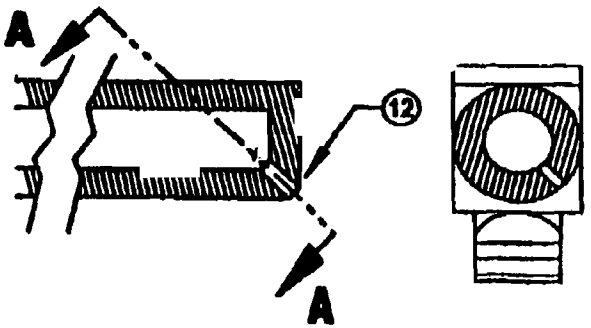
FIG. 4C is a cross sectional view of the clocking of the bleed hole in the front end section of the barrel along arrow A.
Figure 4D:
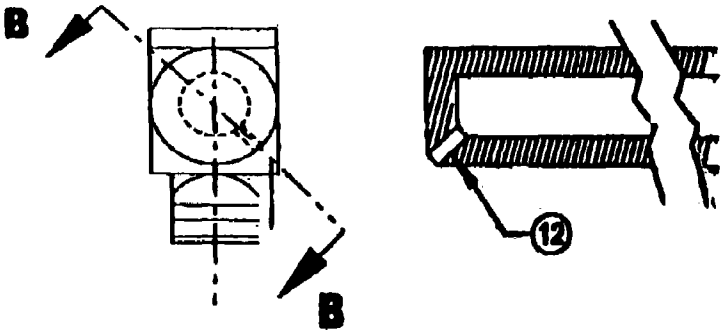
FIG. 4D shows the angle of the bleed hole along arrow B.

FIG. 2 shows a side view of a modified blank cartridge for use with the novel replaceable blank firing barrel. The blank cartridge can have modified dimensions to that of the live ammunition of FIG. 1. The blank cartridge can include for example a smaller outer diameter of approximately 0.3675 inches. The blank firing cartridge can be sized to be up to approximately 10% smaller than live ammunition. The blank rounds can be made undersize to match the chamber dimensions of the novel blank firing barrel to be discussed in reference to FIGS. 3A-3C, 4A-4D and 5. The undersize rounds restrict the use of live ammunition when being used.

FIG. 3A shows a side view of the novel replaceable blank firing barrel. FIG. 3B shows a cross sectional side view of the one-piece, blank firing barrel outlining the angles and design of internal and external features. FIG. 3C is a top view of the blank firing barrel showing the engraving detail on the external surface of the barrel to identify the manufacturer and caliber designation.

Referring to FIGS. 3A-3C and FIG. 4A, the blank firing barrel can be formed by machining such as drilling only one end of a solid metal, such as stainless steel, block so that an opposing solid end remains from the original contiguous metal. The solid end can have a metal web thickness of approximately 0.110 inches thick. It is preferable that the end web be the same thickness as the barrel wall. The internal machining is accomplished by using a boring tool of the same diameter as the bore of the barrel that is to be replaced by the blank firing barrel being manufactured, and stopping said tool one wall thickness short of the barrel end 20, as shown in FIGS. 3A and 3B.

In FIGS. 3A and 3B, the open end of the block 21 functions as a locking breechblock and can have a chamber 22 with a diameter smaller than the existing chamber of a live ammunition-firing barrel. For example, the open end chamber in the blank firing barrel can have a cavity wherein the diameter is sized from approximately 3% up to approximately 10% smaller than the appropriate live ammunition cartridge, and have a depth being approximately 10% shorter than a normal ammunition firing barrel. A chamber reamer is used to provide the mating surface for the blank. The metal work is performed using a foreshortened chamber reamer having the same dimensions as the blank cartridge. The reduced size of the resulting chamber 22 is a safety feature, as it will not allow the chambering of live ammunition. If a user accidentally attempts to use a live round, the larger live round will at best become wedged in the breechblock portion of the novel blank firing barrel. Since live ammunition is longer than the novel blanks used with the invention, the live ammunition cartridge will potentially protrude from the breechblock holding the weapon in an open position which does not allow the weapon to go into a battery, ready to fire, position.

The novel barrel can be machined with various dimensions to change the timing of the firing and cycling of the handgun weapon in which it is used. This is the reason for the chamfering of the top front of the locking breechblock, and the relieving of the rear lug on the bottom of the novel barrel. In FIG. 3B, the novel barrel is chamfered or beveled at the top front of the breechblock 23 at an angle of approximately 45 degrees. This first angle cut removes material that allows the slide to move rearward sooner in the firing sequence. Underneath a rear edge of the breechblock end of the blank firing barrel can be another angled cut 24 up to approximate 32 degrees. The angular removal of material is at the front face of the feed ramp lug located at the rear bottom of the breechblock. These modified under edges can allow the blank firing barrel to recoil (move) inside the handgun when it's fired. Unlike the standard barrels of a regular handgun, this modified barrel can move in a slightly different time frame thereby, still allowing for a shock absorbing effect so that physically using the blank firing barrel more closely replicates shooting live ammunition.

FIG. 3C shows the final step in production of the novel barrel with the engraving of the manufacturer's name and the caliber designation. The external machining of the one-piece replaceable barrel matches the barrel of a conventional weapon except for the angle cuts and bleed hole at the muzzle end.

FIGS. 4A-D show several views of the front section of the barrel having a pressure relieving means 12. The solid end of the blank firing barrel can include a small pressure release opening 12 for allowing gasses to safely escape when a blank cartridge is being fired. The pressure release opening can be angled downward up to approximately 45 degrees exiting from a lower edge of the solid end, and have a diameter of up to approximately 0.062 inches. The downwardly facing orifice is sized and angled so as to avoid injury to anyone standing in front of the gun when a blank is fired and it is also designed to create the optimum backpressure in the barrel to regulate power level and timing of the firing sequence.

Figure 5:
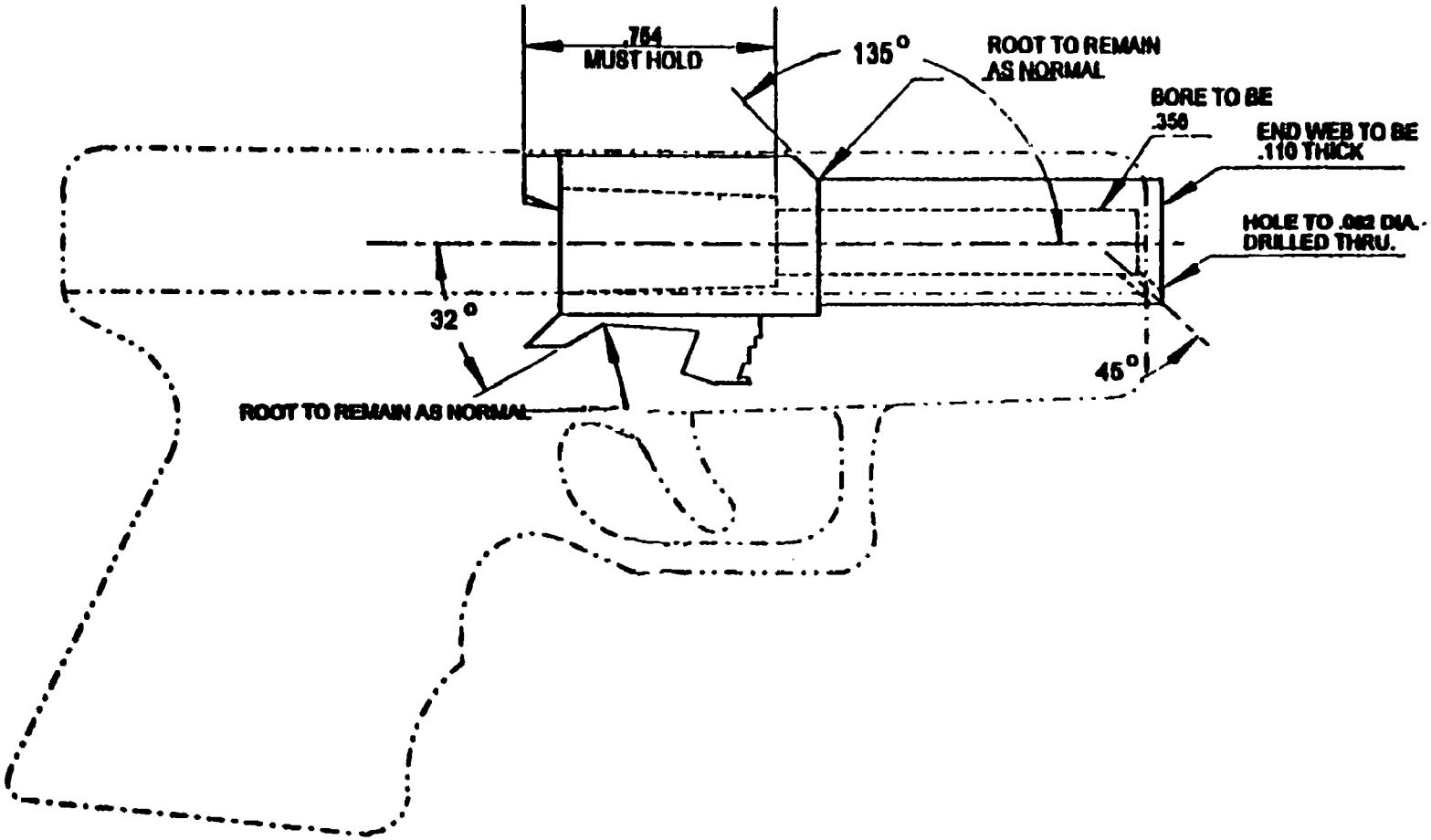
FIG. 5 shows the novel barrel of the preceding figures inserted into a handgun.

FIG. 5 shows the novel barrel of the preceding figures inserted into a handgun. The novel invention barrel is a one-piece, drop-in device, which requires no customized fitting by the user. To be used the novel blank firing barrel can be substituted for a live ammunition-firing barrel without having to destroy the existing live ammunition-firing barrel. The invention does not accept live ammunition and instead restricts the user from mistakenly inserting live ammunition, and instead uses customized blank cartridges such as those formed from brass blanks.

FIG. 6 shows the fabrication of a blank cartridge for the novel blank firing barrels. The cartridge 1 is sized from ammunition-grade, raw brass received from a vendor, such as the Federal Cartridge Company. A raw shell 2 is formed approximately 0.346 inches longer than a standard live round empty shell with a reduced external diameter approximately 0.0153 inches smaller than a standard live round empty shell. The under sizing is necessary to allow a mating with the barrel chamber. The raw shell 2 is fitted with a primer cap 3 inserted into the base prior to filling with gunpowder 4. The judicious selection of gunpowder by someone skilled in the art is necessary for creating the appropriate backpressure when the blank is fired. The neck 5 is sized to form a shoulder for head spacing purposes. The blank cartridge is completed by compression forming a rosette crimp 6 at the open nose end of the shell, closing and sealing to produce the blank cartridge as a finished product 7.

Figures 7A, 7B, 7C:
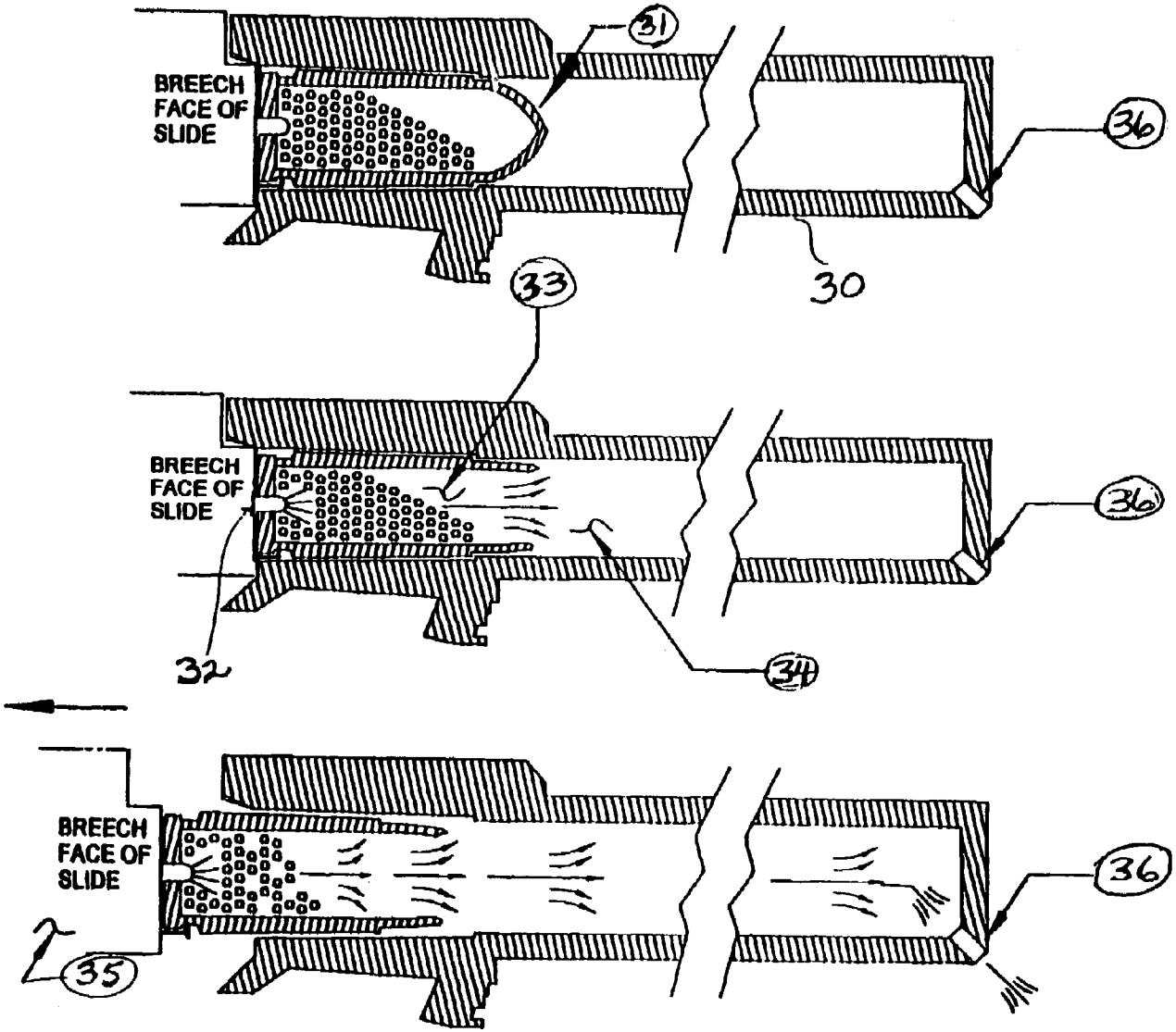
FIG. 7A shows a cross-sectional side view of novel blank firing barrel ready to fire.
FIG. 7B shows a cross-sectional side view of a novel blank firing barrel at the time of firing a blank cartridge.
FIG. 7C shows a cross-sectional side view of a novel blank firing barrel during recoil after firing.

The firearm is loaded in the customary manner using blank cartridges that are prepared as described above. FIG. 7A shows the novel blank firing barrel 30 in battery with the blank cartridge 31 forward into the barrel chamber. FIG. 7B shows the action that occurs when the firing pin strikes the primer cap 32 causing the detonation of the primer cap and the ignition of the enclosed powder charge, which then causes a buildup of gas pressure in the cartridge. The build up of gas pressure causes the cartridge shell crimp to open, releasing gas pressure into the barrel 34. FIG. 7C shows the rearward movement of the cartridge or shell after sufficient pressure has built up to overcome the slide return spring allowing the slide 35 to move rearward with the shell, where the shell is extracted from the barrel chamber continuing rearward until engaged by the ejector which causes automatic ejection of the spent shell. The power level and timing of the firing sequence is partially regulated, by the gas bleed hole 36. Appropriate geometries in sizing the novel blank firing barrel and a customized shell have been used to generate sufficient backpressure to permit repetitive cycling of the magazine in a firearm for firing blank cartridges.

The novel blank firing barrels can also be color coded, such as painted red, yellow, or the like, so that users can easily identify the novel barrels for use.

The novel blank firing barrel can be sized for being fit into various sized handguns, not only GLOCK 17, 19, 23, 26 and 34 models and 9 mm ammunition, but can be used in all calibers, makes and models of firearms. The example disclosed herein shows a novel blank firing firearm using 9 mm ammunition.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A blank firing barrel for handguns, consisting in combination:

an unmodified selected caliber handgun having a barrel receiving cavity with a mounting surface for receiving a live ammunition-firing barrel;

a live ammunition cartridge sized to fit within the live ammunition-firing barrel, the live ammunition cartridge having a selected live ammunition caliber round, so that the selected live ammunition caliber round is to be fired from the live ammunition cartridge, the live ammunition-firing barrel having a mounting surface to fit within the barrel receiving cavity of the handgun;

a unitary one piece elongated metal blank firing barrel formed from a drilled end of a single stainless steel block, having a mounting surface that allows for the unitary one piece elongated blank firing barrel to be easily substituted for the live ammunition-firing barrel in the handgun, the unitary one piece elongated metal blank firing barrel having an open end and an opposing solid end having a flat outer end with a forty-five degree angled pressure release hole, the opposing solid end being formed from the metal blank firing barrel, the unitary one piece elongated metal blank firing barrel having a cavity formed inside the unitary one piece elongated metal blank firing barrel for restricting the unitary one piece elongated metal blank firing barrel to not be able to use the live ammunition cartridge, the cavity having a diameter that is 3% to 10% smaller than the live ammunition cartridge, the cavity of the unitary one piece elongated metal blank firing barrel has a depth 10% shorter than the cavity of the live ammunition firing barrel so that the selected live ammunition caliber round for the handgun cannot be positioned inside of the cavity of the unitary one piece metal blank firing barrel, angled edges formed on the unitary one piece elongated metal blank firing barrel for allowing the unitary one piece elongated metal blank firing barrel to recoil in the handgun when the handgun is fired with the blank cartridge, the angled edges include a first angled cut at the top forward end of a breechblock and a second angled cut in a rear lug position underneath the unitary one piece elongated metal blank firing barrel, wherein the live ammunition cartridge used with the handgun is prevented from being inserted into the unitary one piece elongated metal blank firing barrel, and the selected live caliber round that is used with the handgun is prevented from being fired from unitary one piece elongated metal blank firing barrel, and wherein the unitary one piece elongated metal blank firing barrel does not use a plug, does not use a cap, does not use a bushing and does not use a restrictor component inside the unitary one piece elongated metal blank firing barrel, and the handgun does not require any customization to make it function with the unitary one piece elongated metal blank firing barrel, and the handgun is not destroyed by using the unitary one piece elongated metal blank firing barrel.

2. The blank firing barrel of claim 1, wherein the first angled cut is greater than the second angled cut.

3. The blank firing barrel of claim 2, wherein the opposing solid end with pressure reliever is 0.110 inches thick.

* * * * *